US008146470B2

(12) United States Patent
Zhou et al.

(10) Patent No.: US 8,146,470 B2
(45) Date of Patent: Apr. 3, 2012

(54) DIE STAMPING SYSTEM

(75) Inventors: Shu-Wei Zhou, Shenzhen (CN); Fu-Shun Huang, Taipei Hsien (TW); Chia-Hsiang Ou, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 694 days.

(21) Appl. No.: 12/189,804

(22) Filed: Aug. 12, 2008

(65) Prior Publication Data

US 2009/0266208 A1 Oct. 29, 2009

(30) Foreign Application Priority Data

Apr. 28, 2008 (CN) ..... 2008 1 0301328

(51) Int. Cl.
*B26D 7/06* (2006.01)

(52) U.S. Cl. ..... 83/128; 83/582; 83/698.91; 83/699.41

(58) Field of Classification Search ..... 83/128, 83/582, 588, 635, 638, 671, 673, 684, 669, 83/670, 698.91, 699.41
See application file for complete search history.

(56) References Cited

U.S. PATENT DOCUMENTS

| | | | | |
|---|---|---|---|---|
| 4,377,957 | A * | 3/1983 | Wheeler | 83/103 |
| 4,471,680 | A * | 9/1984 | Gerhart | 83/588 |
| 4,579,022 | A | 4/1986 | Kasai et al. | |
| 6,076,447 | A * | 6/2000 | Damask | 83/618 |
| 6,089,137 | A * | 7/2000 | Lee | 83/621 |
| 6,170,375 | B1 * | 1/2001 | Fidziukiewicz | 83/627 |
| 6,428,248 | B1 * | 8/2002 | Lee | 407/117 |
| 7,690,121 | B2 * | 4/2010 | Lam et al. | 30/363 |
| 2008/0314220 | A1 * | 12/2008 | Ferry et al. | 83/684 |
| 2009/0223032 | A1 * | 9/2009 | Huang et al. | 29/525.01 |
| 2009/0266134 | A1 * | 10/2009 | Huang et al. | 72/327 |

* cited by examiner

*Primary Examiner* — Boyer D Ashley
*Assistant Examiner* — Omar Flores-Sánchez
(74) *Attorney, Agent, or Firm* — Altis Law Group, Inc.

(57) ABSTRACT

A die stamping system includes an upper die, a sliding block, a lower stripper, a die holder connected to the lower stripper, and a lower die-set moveably connected to the die holder. The sliding block includes a body with a wedge-shaped head facing down, a punch connected to the body, and two arms on opposite sides of the body, respectively. The lower stripper matches the upper die-set and has an aperture for passage of the punch therethrough. The die holder is connected to the lower stripper and includes an opening for passage of the body therethrough, and a first notch receiving the two arms. The first notch is larger than the arms. The lower die-set is movably connected to the die holder and includes a wedge-shaped padding block facing up and supporting the wedge-shaped head of the body.

6 Claims, 5 Drawing Sheets

DIE STAMPING SYSTEM

BACKGROUND

1. Technical Field

The present invention relates to a die stamping system and, particularly, to a die stamping system having a sliding block with a punch.

2. Description of Related Art

The objective of a typical fine die stamping apparatus is accurate cutting and punching of a workpiece. Such apparatus usually includes an upper die and a lower die, with one or more punches associated with the upper die and a punch base associated with the lower die, movable with respect to the lower die. To ensure necessary precision during formation of parts, it is common to provide a locating configuration in a workpiece. Referring to FIG. 5, a conventional locating configuration 1 of a workpiece 2 is shown. The location configuration 1 of the workpiece 2 is formed by means of a conventional half-cut punch method. However, the location configuration 1 may decrease the strength and aesthetic appearance of the workpiece 2.

It is desired to provide a die stamping system having a sliding block that can overcome the described limitations.

SUMMARY

In accordance with the present invention, a die stamping system includes an upper die, a sliding block, a lower stripper, a die holder connected to the lower stripper, and a lower die-set moveably connected to the die holder. The sliding block includes a body with a wedge-shaped head facing downwardly, a punch connected to the body, and two arms on opposite sides of the body, respectively. The lower stripper matches the upper die and has an aperture for passage of the punch therethrough. The die holder is connected to the lower stripper and includes an opening for passage of the body therethrough, as well as a first notch loosely receiving the two arms. The lower die-set is movably connected to the die holder and includes a wedge-shaped padding block facing up, supporting the wedge-shaped head of the body.

Other novel features and advantages will become more apparent from the following detailed description when taken in conjunction with the accompanying drawings.

BRIEF DESCRIPTION OF THE DRAWINGS

Many aspects of the present die stamping system can be better understood with references to the following drawings. The components in the drawings are not necessarily drawn to scale, the emphasis instead being placed upon clearly illustrating the principles of the present die stamping system.

DETAILED DESCRIPTION OF EXEMPLARY EMBODIMENTS

Figure 1:
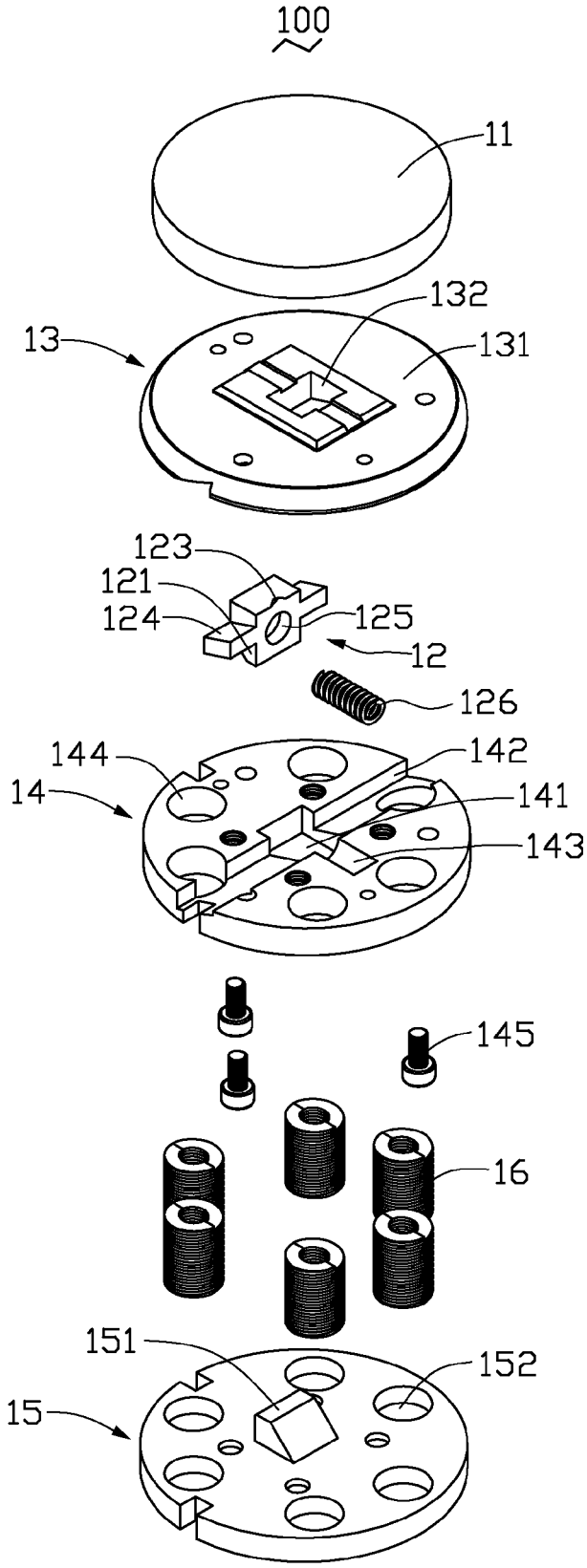
FIG. 1 is an isometric, exploded view of a die stamping system according to an exemplary embodiment of the present invention.
Figure 2:
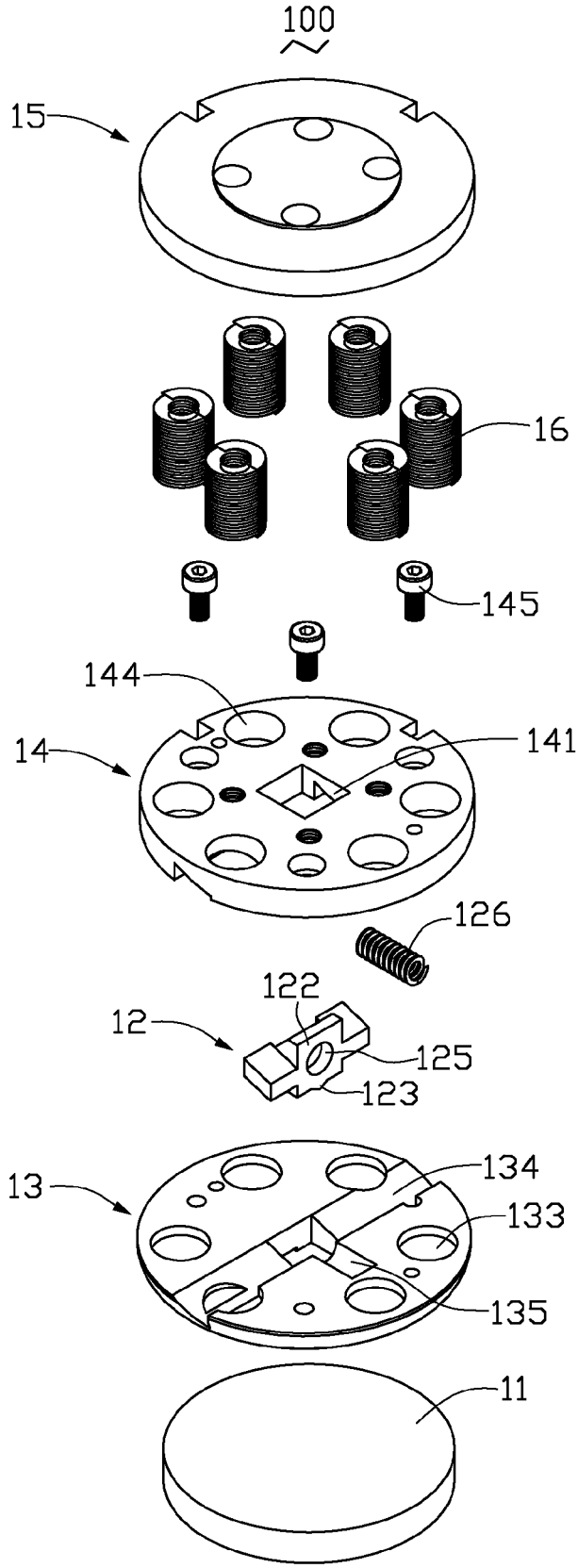
FIG. 2 is similar to FIG. 1, showing the die stamping system from a different angle.
Figure 3:
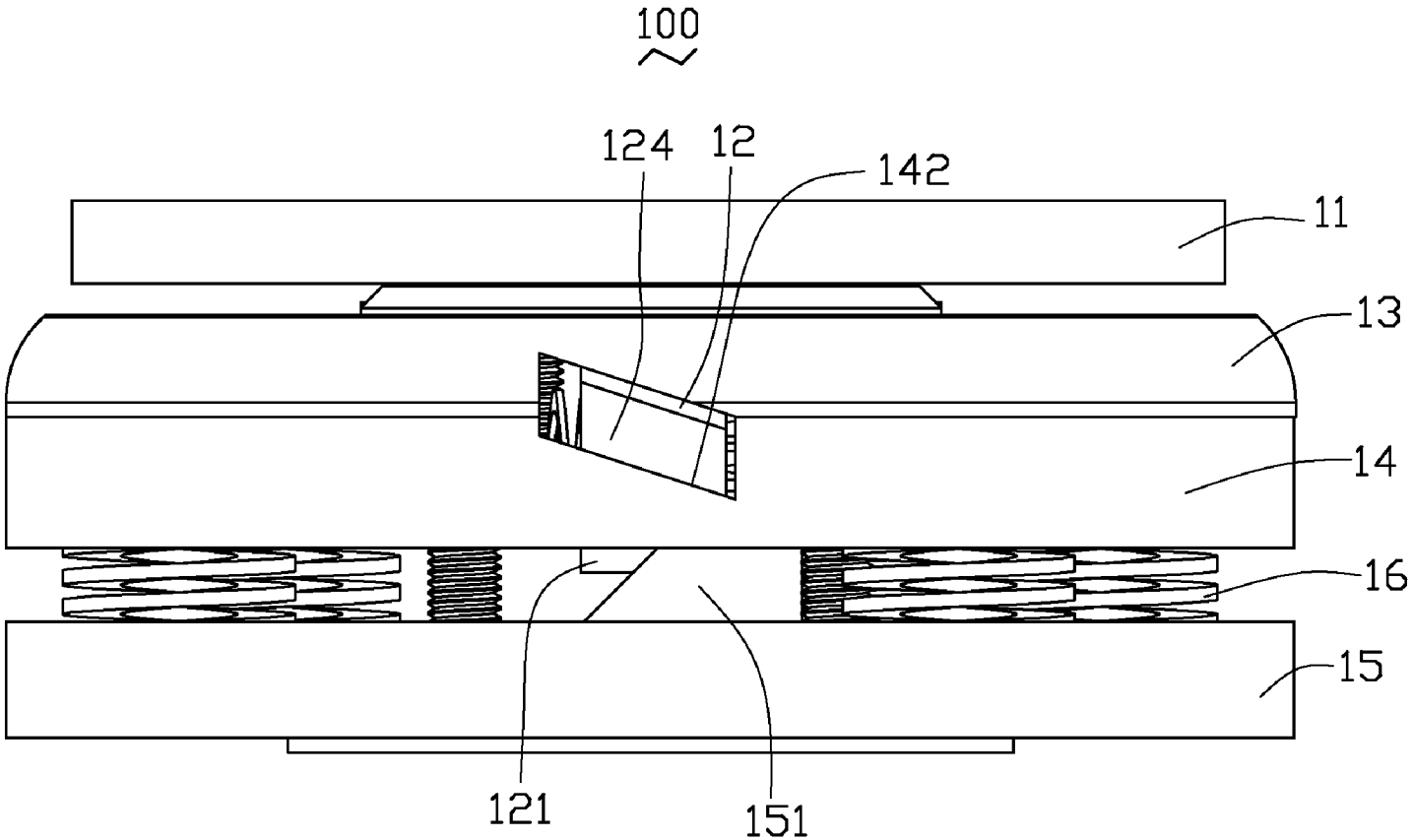
FIG. 3 is an assembled, isometric view of FIG. 1.

A detailed explanation of a die stamping system according to an exemplary embodiment of the present invention will now be made with references to the drawings attached hereto.

Referring to FIGS. 1-4, a die stamping system 100 according to an exemplary embodiment of the present embodiment is shown. The die stamping system 100 includes an upper die 11, a sliding block 12, a lower stripper 13 movable with respect to the upper die 11, a die holder 14 connected to the lower stripper 13, and a lower die-set 15 connected to the die holder 14, and more than two ejection springs 16 disposed between the lower stripper 13 and the lower die-set 15. The upper die 11 is connected to a stamping molding machine (not shown) after being matched with a die face 131 of the lower stripper 13 therebetween.

The sliding block 12 includes a body 121 with a wedge-shaped head 122 facing the lower die-set 15, a punch 123 formed on the body 121, and two arms 124 on opposite sides of the body 121, respectively. The punch 123 has a form corresponding to that of the object to be stamped, such as a hole, or other. In the present embodiment, the punch 123 has a wedge-shaped punch for extruding a workpiece 20 into which a locating entrance is to be punched (shown in FIG. 4). The two arms 124 are configured for cooperating with the die holder 14 to control movement of the body 121. The two arms 124 may be connected to two sides of the body 121 by any conventional method, such as screws, welding, and the like, or may also be directly integrated with the body 121. In the present embodiment, the two arms 124 are directly integrated with the body 121. The sliding block 12 further includes a cavity 125 defined in the body 121 and an offsetting spring 126 received in the cavity 125. The offsetting spring 126 is configured for retrieving the body 121 after stamping.

The lower stripper 13 has an aperture 132 for passage of the punch 123 therethrough during stamping and at least two recesses 133 for containing a bottom of the ejection spring 16. In the present embodiment, the lower stripper 13 has six recesses 133. The lower stripper 13 further includes a first notch 134 for receiving the two arms 124 of the sliding block 12 and a second notch 135 for receiving the offsetting spring 126. The first notch 134 is larger than the two arms 124, allowing movement thereof therethrough during stamping.

The die holder 14 has an opening 141 for passage of the body 121 of the sliding block 12 therethrough and a third notch 142 receiving the two arms 124 of the sliding block 12. The third notch 142 is larger than the two arms 124 so that the die holder 14 can drive the sliding block 12 along the third notch 142 during stamping. The die holder 14 further includes a fourth notch 143 receiving the offsetting spring 126 and six apertures 144 for passage of the offsetting springs 126 therethrough. A total axial length of the cavity 125 and the second notch 143 is equal to or less than an original axial length of the offsetting spring 126. The die holder 14 is connected to the lower stripper 13 via a number of first bolts 145. In the present embodiment, the die holder 14 includes three bolts 144.

The lower die-set 15 is fixed on the stamping molding machine and includes a wedge-shaped padding block 151 locked thereon and six third blind holes 152 receiving the tops of the offsetting springs 126. The wedge-shaped padding block 151 has a wedge-shaped side facing up towards the upper die 11 and configured for supporting the body 121 of the sliding block 12. It should be noted that the lower die-set 15 is connected to the die holder 14 via a number of second bolts (not shown) as in a conventional die.

Figure 4:
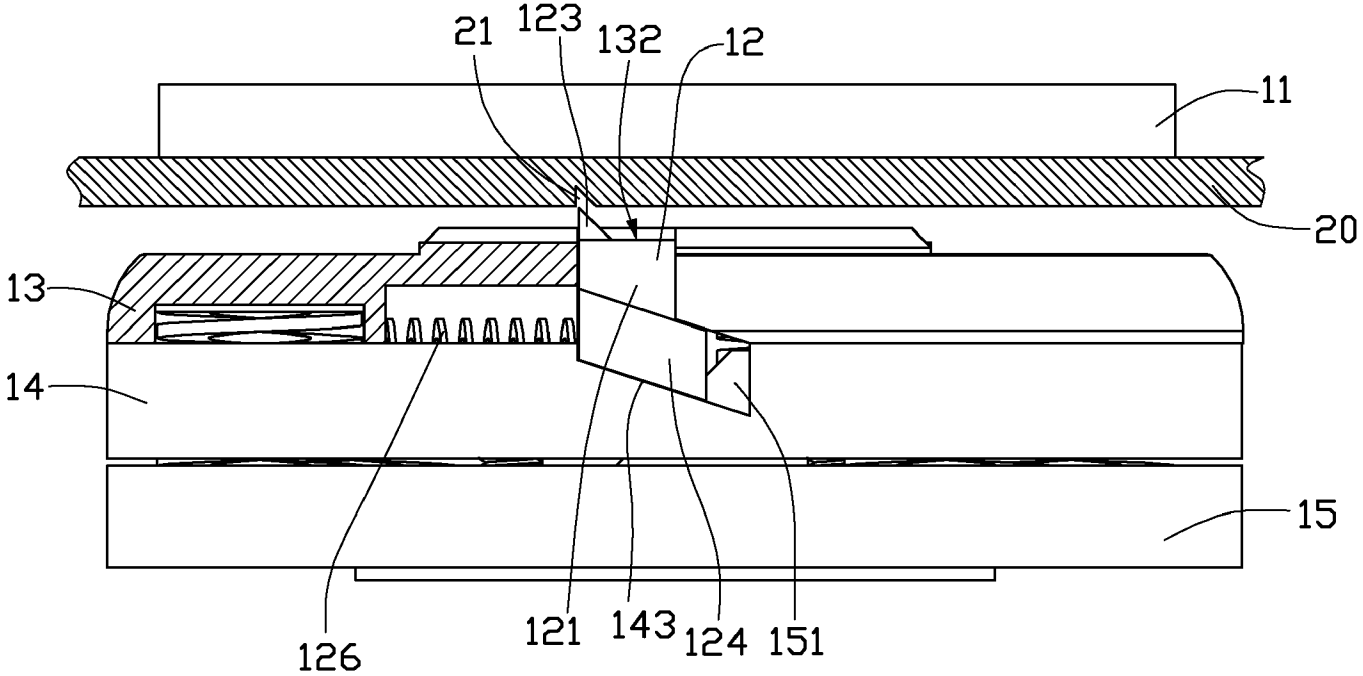
FIG. 4 is a partial cross-section of FIG. 3 during stamping of a workpiece.
Figure 5:
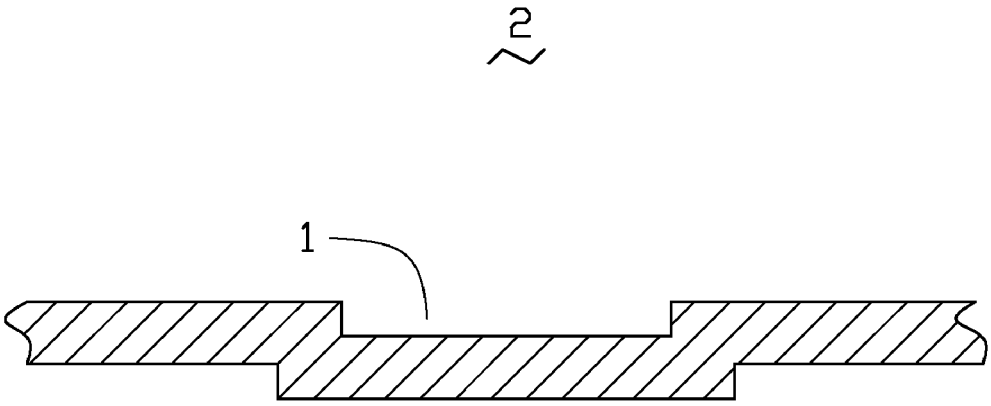
FIG. 5 (RELATED ART)
FIG. 5 shows a conventional locating configuration on a workpiece punched by a conventional method.

During operation, when the upper die 11 presses down on the lower stripper 13 and the die holder 14, the punch 123 of the sliding block 12 extends from the aperture 132 of the lower stripper 12 and extrudes the workpiece 20, as shown in FIG. 4. As a result, a locating configuration 21 is formed. After stamping, the ejection springs 16 drive the die holder 13 and the lower stripper 11 to move upwardly and the offsetting spring 126 synchronously allows the sliding block 12 to return. The stamping process is repeated.

As described, the slidable punch 123 extrudes the location configuration 21 on the workpiece 20. The depth of the location configuration can be adjusted by adjusting the bolts 145, altering the distance between the lower stripper 13 and the die holder 14. Therefore, the die stamping system can stamp different location configurations and improve the strength and aesthetic appearance of the workpiece, especially in comparison with the conventional half-cat punch method.

It should be understood that the described embodiment is intended to illustrate rather than limit the invention. Variations may be made to the embodiments without departing from the spirit of the invention. Accordingly, it is appropriate that the appended claims be construed broadly and in a manner consistent with the scope of the invention.

What is claimed is:

1. A die stamping system, comprising:

an upper die;

a sliding block comprising a body with a wedge-shaped head facing downwardly, a punch connected to the body, and two arms on opposite sides of the body, respectively;

a lower stripper matching the upper die and having a aperture for a passage of the punch therethrough;

a die holder connected to the lower stripper and comprising an opening for passage of the body therethrough, and a first notch for receiving the two arms, wherein the first notch is larger than the arms; and a lower die-set movably connected to the die holder and comprising a wedge-shaped padding block facing up, supporting the wedge-shaped head of the body, wherein the sliding block further comprises a cavity defined in the body and an offsetting spring received in the cavity, and the die holder further comprises a second notch receiving the offsetting spring, wherein a total axial length of the cavity and the second notch is equal to or less than an axial length of the offsetting spring.

2. The die stamping system as claimed in claim 1, wherein the arms extend from the body of the sliding block.

3. The die stamping system as claimed in claim 1, wherein the arms are connected to the body of the sliding block via bonding.

4. The die stamping system as claimed in claim 1, wherein the punch is integrally formed with the body.

5. The die stamping system as claimed in claim 1, wherein the die stamping system further comprises at least two ejection springs, the lower die-set further comprises at least two recesses respectively receiving tops of the ejection springs, the die holder further comprises at least three through holes for passage of the ejection springs therethrough according to the recesses, and the lower stripper further comprises at least two third blind holes receiving bottoms of the ejection springs.

6. The die stamping system as claimed in claim 1, wherein the punch is wedge-shaped.

* * * * *